US007526889B2

(12) United States Patent
Metzger et al.

(10) Patent No.: US 7,526,889 B2
(45) Date of Patent: May 5, 2009

(54) TRIGGER MECHANISM FOR HANDGUNS

(75) Inventors: Thomas Metzger, Eckernförde (DE); Stefan Höfs, Eckernförde (DE); Adrian Thomele, Eckernförde (DE)

(73) Assignee: S.A.T. Swiss Arms Technology AG, Neuhausen (CH)

( * ) Notice: Subject to any disclaimer, the term of this patent is extended or adjusted under 35 U.S.C. 154(b) by 0 days.

(21) Appl. No.: 11/775,659

(22) Filed: Jul. 10, 2007

(65) Prior Publication Data

US 2008/0010889 A1 Jan. 17, 2008

(30) Foreign Application Priority Data

Jul. 11, 2006 (EP) ..... 06014336

(51) Int. Cl.
*F41A 3/00* (2006.01)

(52) U.S. Cl. ..... 42/69.03; 42/69.01; 42/69.02; 89/131; 89/147; 89/154

(58) Field of Classification Search ..... 42/69.01–69.03; 89/131, 147, 154
See application file for complete search history.

(56) References Cited

U.S. PATENT DOCUMENTS

| | | | | |
|---|---|---|---|---|
| 4,522,105 | A | 6/1985 | Atchisson | |
| 5,086,579 | A * | 2/1992 | Flatley et al. | 42/70.08 |
| 5,400,537 | A * | 3/1995 | Meller et al. | 42/69.03 |
| 6,289,619 | B1 * | 9/2001 | Fuchs et al. | 42/69.03 |
| 6,588,136 | B2 * | 7/2003 | Baker et al. | 42/70.05 |
| 2003/0070342 | A1 | 4/2003 | Baker et al. | |
| 2004/0020095 | A1 * | 2/2004 | Beretta | 42/69.03 |

FOREIGN PATENT DOCUMENTS

| | | | |
|---|---|---|---|
| AT | 374 001 | B | 3/1984 |
| DE | 197 32 857 | C1 | 10/1998 |
| DE | 196 26 077 | C2 | 10/2000 |
| DE | 198 46 657 | C2 | 2/2001 |
| DE | 100 14 687 | C1 | 7/2001 |
| DE | 10 2004 007 407 | A1 | 8/2004 |
| EP | 550 238 | A1 | 7/1993 |
| EP | 0 816792 | B1 | 6/1997 |
| WO | WO 98/51984 | | 11/1998 |

* cited by examiner

*Primary Examiner*—Stephen M Johnson
*Assistant Examiner*—Daniel J Troy
(74) *Attorney, Agent, or Firm*—Martin Fleit; Paul Bianco; Fleit Gibbons Gutman Bongini & Bianco PL

(57) ABSTRACT

The invention pertains to a trigger mechanism for handguns, particularly pistols, with a striking lever (2), a first striking spring (3) that is assigned to the striking lever (2) and serves for acting upon the striking lever (2) in the firing direction, a trigger (12) and a trigger rod (13) that is connected to the trigger (12) and releases the striking lever (2) in a tensioned position in order to fire a shot. In order to generate a constant firing energy with variable trigger resistances and trigger paths, the striking lever (2) is acted upon in the firing direction by a second striking spring (5) that is arranged parallel to the first striking spring (3).

18 Claims, 11 Drawing Sheets

TRIGGER MECHANISM FOR HANDGUNS

CROSS REFERENCE TO RELATED APPLICATION

This application claims priority under 35 U.S.C. §119 to European Patent Application No. 06 014 336.9 filed Jul. 11, 2006, the entire contents of which are incorporated herein by reference.

FIELD OF THE INVENTION

The invention pertains to a trigger mechanism for handguns, particularly pistols.

BACKGROUND OF THE INVENTION

A trigger mechanism of this type is known from US 2003/0070342. The trigger mechanism disclosed in this publication also features a striking lever, two parallel striking springs that are assigned to the striking lever and act upon the striking lever in the firing direction, a trigger, a trigger rod that is connected to the trigger and a control element that is rotatably arranged in the striking lever and features a control element detent for engaging with a trigger rod detent of the trigger rod.

SUMMARY OF THE INVENTION

The invention is based on the objective of developing a trigger mechanism of the initially cited type in which a constant firing energy can be realized with variable trigger resistances and trigger paths.

This objective is realized with a trigger mechanism as set forth in the claims. Effective developments and advantageous additional refinements of the invention are defined in the dependent claims.

In the inventive trigger mechanism, the required firing energy is generated by two separate striking springs that can be individually adapted to one another. One of the two striking springs can be used for storing pre-tensioning energy while the second striking spring is tensioned by means of the trigger and defines the trigger force or the trigger resistance. The pre-tensioning of one striking spring can be realized, e.g., by manually actuating the striking lever or with the breech lock that automatically returns due to the recoil when a shot is fired. The second striking spring is tensioned by the shooter with the aid of the trigger and generates the actual trigger force. The total energy required for firing a cartridge is generated by both striking springs such that the trigger resistance can be adjusted and easily adapted to the different requirements of the shooter. The striking lever features an integral control element with a control element detent for engaging with a trigger rod detent of the trigger rod. The trigger characteristic can be easily adjusted with this control element. A pre-tensioned trigger mechanism can be realized, e.g., by rotatably arranging the control element in the striking lever so that it cooperates with a drive element that makes it possible to pre-tension or release the second striking spring. The control element that can be turned by means of the trigger rod makes it possible to actuate the drive element, e.g., in such a way that, when the trigger is pulled back, it releases the second striking spring that was previously pro-tensioned by manually actuating the striking lever or by the return movement of the breech lock, and the striking lever is acted upon by both striking springs. A catch is not required if the pro-tensioned trigger mechanism is intended only for double-action mode. However, a catch is required for a pre-tensioned single-action mode.

If no pre-tensioned trigger mechanism is needed, the control element can also be arranged in the striking level so that it does not turn relative to it. This may be realized, e.g., by connecting the control element to the striking lever without rotational play with an additional pin. The control element may, however, also be replaced with a control element that is arranged in the striking lever with a positive fit. This makes it possible to eliminate the drive element and to realize a single-action-only mode, a double-action-only mode or a single-action/double-action mode. For the double-action-only mode, only a safety lever and at least one striking spring are required in addition to the control element, whereas for the single-action-only mode and for the single-action/double-action mode, in addition to the control element, safety lever and at least one striking spring, a catch is also required.

In the inventive trigger mechanism, the trigger characteristic and operation can be modified simply and without problem by exchanging individual elements. The modifications can be easily carried out and realized without added costs.

BRIEF DESCRIPTION OF THE DRAWINGS

Other particularities and advantages of the invention are disclosed in the following description of a preferred embodiment with reference to the drawing. It shows.

DETAILED DESCRIPTION OF THE INVENTION

Figure 1:
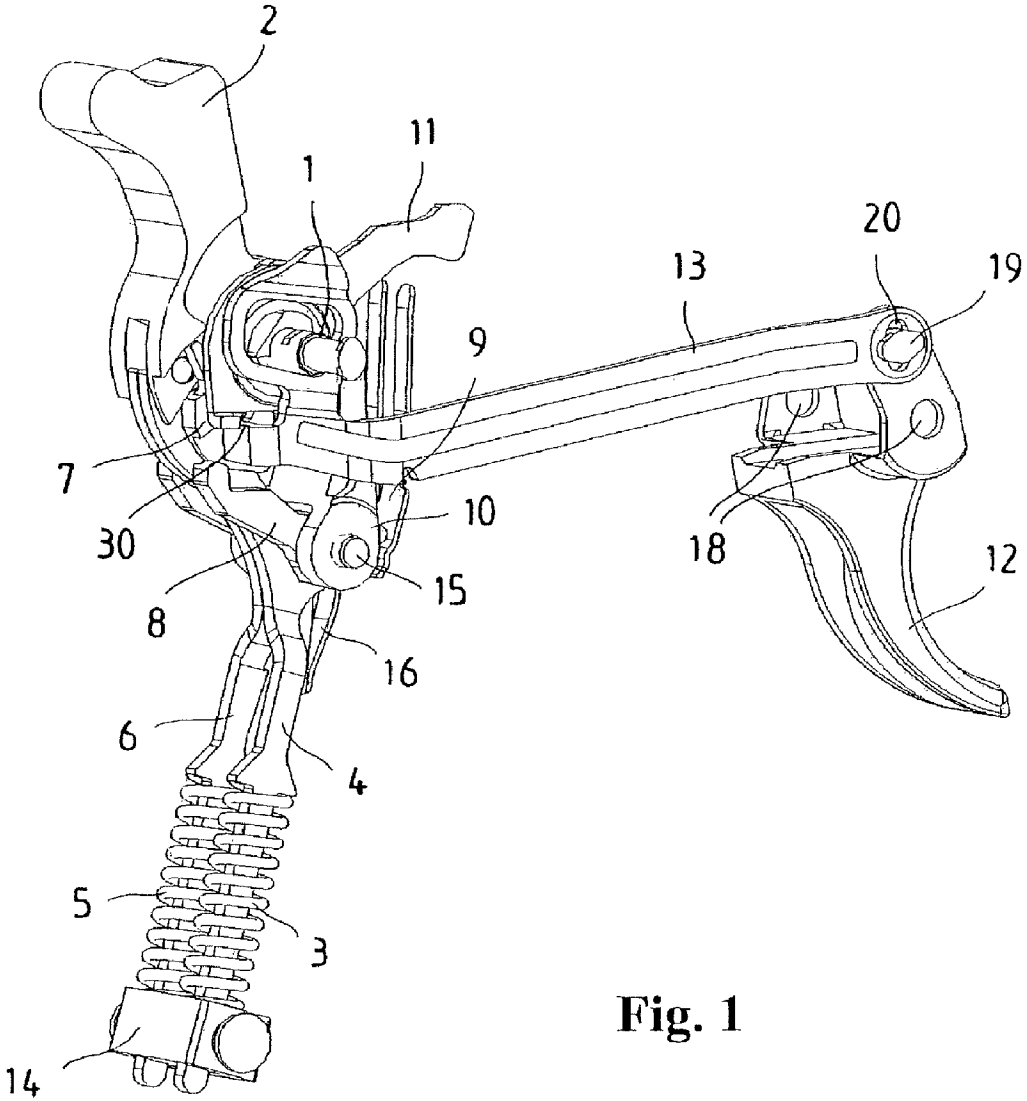
FIG. 1, a trigger mechanism of a pistol that is situated in an initial position in the form of a perspective representation viewed from the rear.
Figure 2:
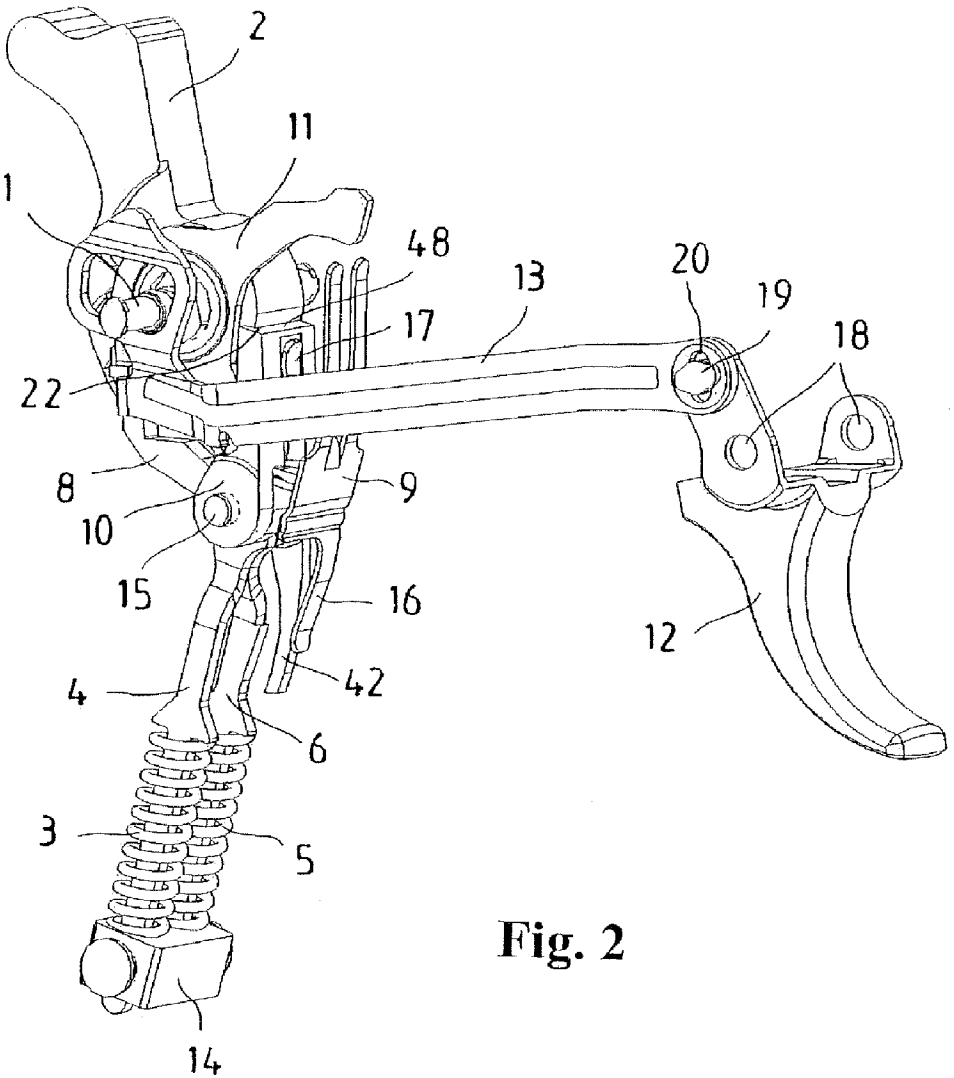
FIG. 2, the trigger mechanism in the initial position according to FIG. 1 in the form of a perspective representation viewed from the front.

FIGS. 1 and 2 respectively show a trigger mechanism of a pistol in an initial position, namely in the form of perspective representations viewed from the rear and from the front, wherein said trigger mechanism comprises a striking lever 2 that is rotatably supported on a striking lever axis 1, a first striking spring rod 4 that is acted upon by a first striking spring 3, a second striking spring rod 6 that is acted upon by a second of striking spring 5, a control element 7 that is assigned to the striking lever 2, a lever-shaped drive element 8, a spring 9, a catch 10, a safety lever 11, a trigger 12 and a trigger rod 13 that is articulately connected to the trigger 12 on its front end and cooperates with the control element 7 on its rear end. The two striking springs 3 and 5 cause the two striking spring rods 4 and 6 to act upon the striking lever 2 in the firing direction so as to actuate a not-shown striking pin. The two striking springs 3 and 5 are supported on a striking spring abutment 14 with their lower ends. The drive element 8 and the catch 10 are arranged so that they can be pivoted about a transverse shaft 15. The spring 9 features a lower leg 16 that is in contact with the drive element 8 and a rear leg 17 that is illustrated in FIG. 2 and presses the catch 10 against the striking lever 2. The trigger 12 is pivotably arranged in a carrier or grip section of the pistol by means of bores 18 and a not-shown transverse pin. The trigger 12 is articulately connected to the trigger rod 13 by means of a pin 19 that is laterally formed onto the trigger 12 and a corresponding oblong hole 20 on the front end of the trigger rod 13. The trigger rod 13 is pressed rearward and upward with the aid of a not-shown trigger rod spring.

Figure 3:
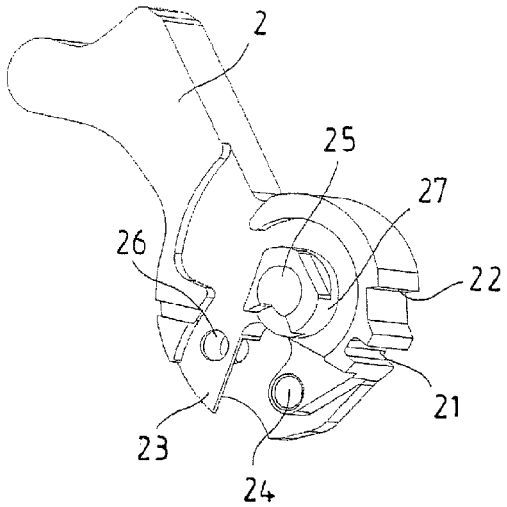
FIG. 3, a striking lever of the trigger mechanism according to FIG. 1 in the form of a perspective representation.
Figure 7:
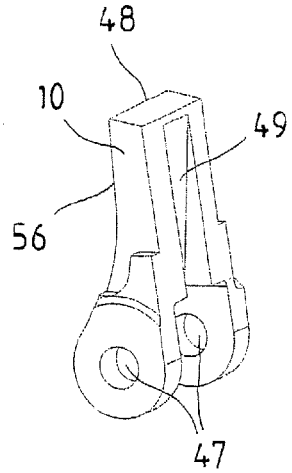
FIG. 7, a catch of the trigger mechanism according to FIG. 1 in the form of a perspective representation.

FIG. 3, in particular, shows the striking lever 2 that is rotatably Mounted on the striking lever axis 1 within the carrier or grip section of the pistol, wherein said striking lever features a firing detent 21 on its front side and a safety detent 22 that is arranged above the firing detent and serves for engaging with the catch 10 illustrated in FIG. 7. The striking lever 2 furthermore features a lateral recess 23 and a bore 24 for supporting the control element 7 shown in FIG. 4. The bore 24 for the control element 7 is arranged beneath a through-hole 25 for the striking lever axis 1. Another transverse bore 26 located behind the through-hole 25 is provided for a not-shown transverse pin, on which the two striking spring rods 4 and 6 are supported with their upper ends. The striking lever 2 furthermore contains a lateral bearing stud 27 that is arranged concentric to the through-hole 25 and serves for rotatably supporting the safety lever 11 shown in FIG. 5.

Figure 4:
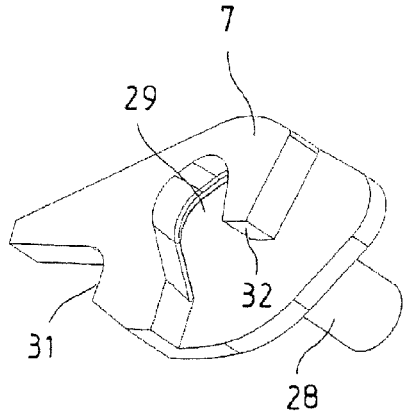
FIG. 4, the control element of the trigger mechanism according to FIG. 1 in the form of a perspective representation.

FIG. 4 shows the control element 7 that is arranged between the striking lever 2 and the safety lever 11. It features a laterally protruding pin 28 for inserting the control element 7 into the bore 24 of the striking lever 2 that is laterally offset relative to the through-hole 25 for the striking lever axis 1, as well as for rotatably supporting the control element 7 in the striking lever 2. The control element 7 furthermore features a control element detent 29 in the form of a lateral groove that serves for engaging with a trigger rod detent 30 shown in FIG. 9. The control element 7 also features a first rear control surface 31 for engaging with a contact surface 46 on the drive element 8 shown in FIG. 6 and a second front control surface 32 that cooperates with the trigger rod detent 30 in order to turn the control element 7.

Figure 5:
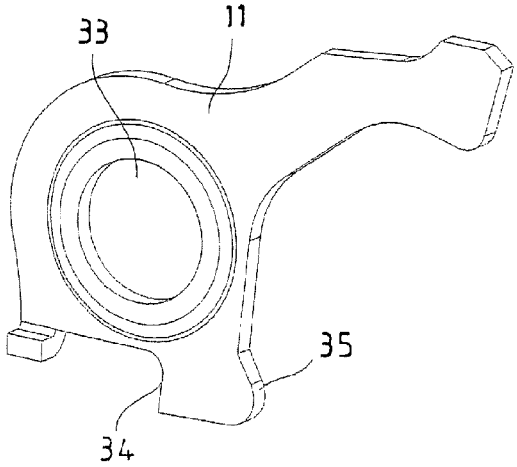
FIG. 5, a safety lever of the trigger mechanism according to FIG. 1 in the form of a perspective representation.

The safety lever 11 shown in FIG. 5 is pivotably arranged on the hearing stud 27 of the striking lever 2 with the aid of a bore 33. On its underside, it features a safety lever detent 34 and a safety lever cam 35 that is arranged in front of the safety lever detent and cooperates with the catch 10.

Figure 6:
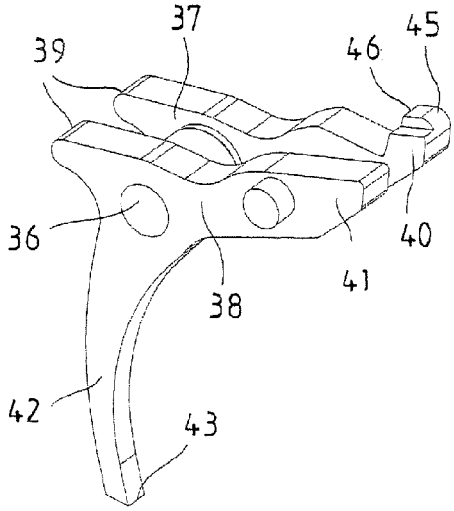
FIG. 6, a drive element of the trigger mechanism according to FIG. 1 in the form of a perspective representation.
Figure 8:
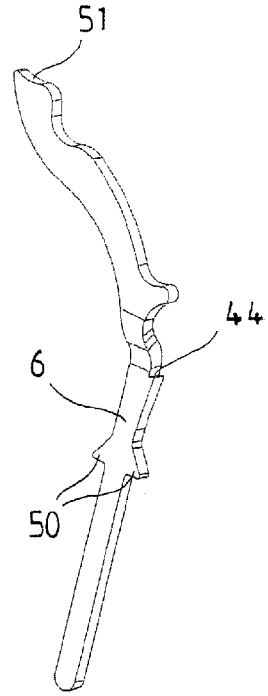
FIG. 8, a striking spring rod of the trigger mechanism according to FIG. 1 in the form of a perspective representation.

According to FIG. 6, the lever-shaped drive element 8 contains a bore 36 for the transverse shaft 15 and two parallel lever arms 37 and 38 with forward projections 39 and two rearward extensions 40 and 41, respectively. The front lever arm 38 in FIG. 6 furthermore features a downward projection 42. A drive detent 43 that engages with a striking spring rod detent 44 on the second striking spring rod 6 shown in FIG. 8 is located on the lower end of the downward projection 42. The rearward extension 40 of the rear lever arm 37 in FIG. 6 features an upwardly projecting control cam 45 with a contact surface 46 that engages with the control surface 31 of the control element 7.

FIG. 7 shows an enlarged representation of the catch 10 that features two parallel arms with transverse bores 47 for the transverse shaft 15 on its underside and a catch detent 48 for engaging with the safety detent 22 on the front side of the striking lever 2 shown in FIG. 2 on its upper side. The front side of the catch 10 furthermore contains a groove 49, into which the front leg 17 of the pressure spring 9 engages.

FIG. 8 shows the second striking spring rod 6 with the striking spring rod detent 44 for engaging with the drive detent 43 arranged on its front side. The striking spring rod 6 features front and rear abutments 50 for the upper end of the second striking spring 5 underneath the drive detent 43. The upper end of the striking spring rod 6 is provided with a contact surface 51 that serves for supporting the striking spring rod 6 on a transverse pin that is inserted into a transverse bore 26 of the striking lever 2 shown in FIG. 3.

Figure 9:
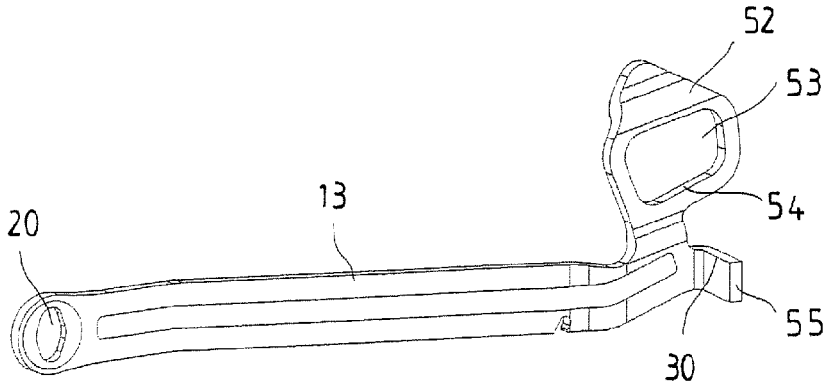
FIG. 9, a trigger rod of the trigger mechanism according to FIG. 1 in the form of a perspective representation.

According to FIG. 9, the trigger rod 13 features an oblong hole 20 for the pin 19 provided on the trigger 12 according to FIG. 1 on its front end that is bent inwardly. On its rear end, the trigger rod 13 features an upwardly projecting bracket 52 with an oblong hole 53, on which the control bevel 54 is realized the cooperates with the striking lever axis 1. On its rear end, the trigger rod 13 also features an inwardly bent arm 55 with the trigger rod detent 30 for engaging with the control element detent 29 of the control element 7.

The operation of the above-described trigger mechanism is explained below with reference to FIGS. 1-16.

Figure 10:
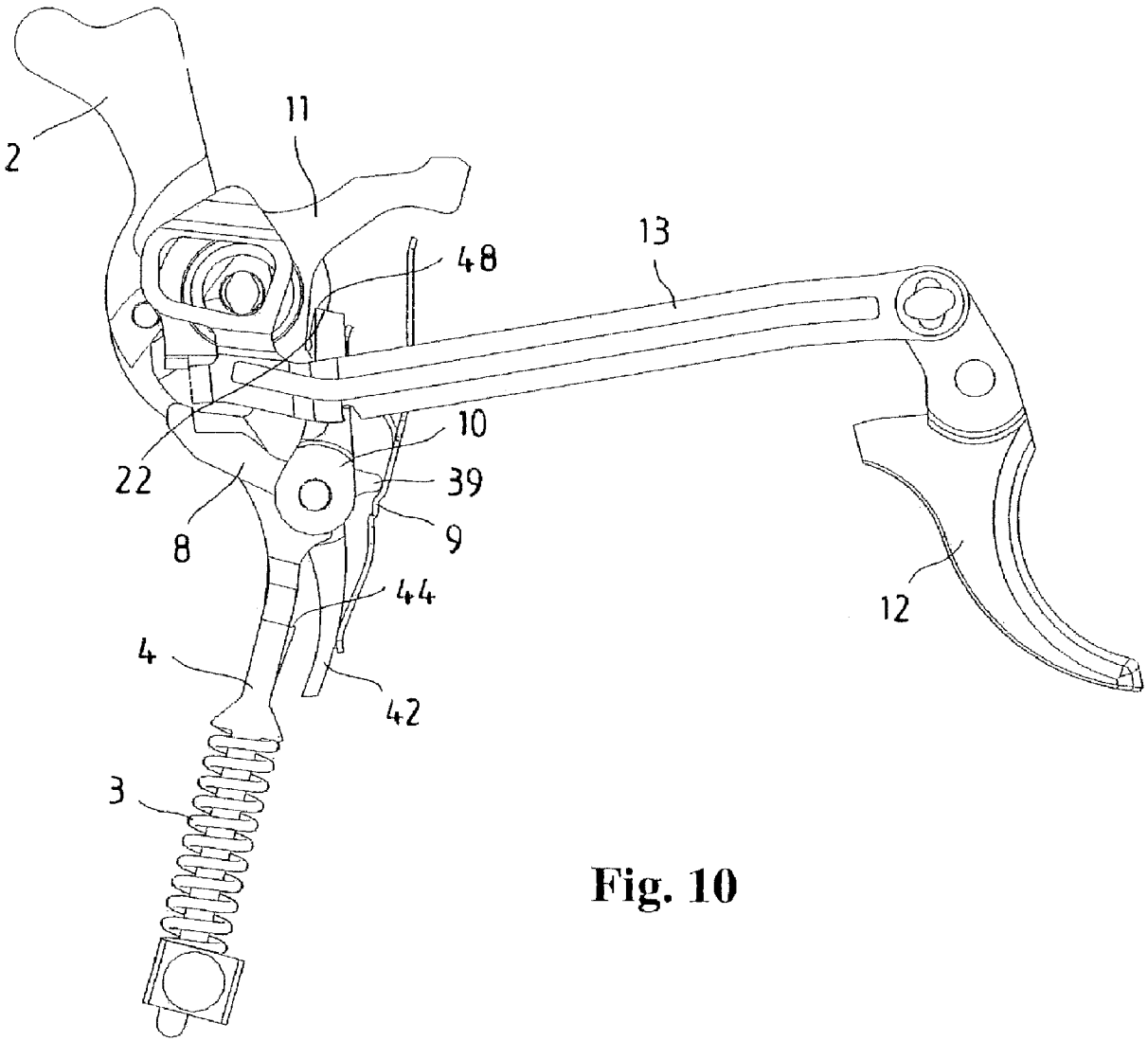
FIG. 10, the trigger mechanism in the initial position according to FIG. 1 in the form of a side view.

FIGS. 1, 2 and 10 show the trigger mechanism in a completely untensioned initial position. In this position, the catch detent 48 of the catch 10 according to FIGS. 2 and 10 is engaged with the safety detent 22 of the striking lever 2. Consequently, the striking lever 2 is held in a front initial position by the catch 10. In this position, the downward projection 42 of the drive element 8 is spaced apart from the striking spring rods 4 and 6, and both striking springs 3 and 5 are completely relaxed.

Figure 11:
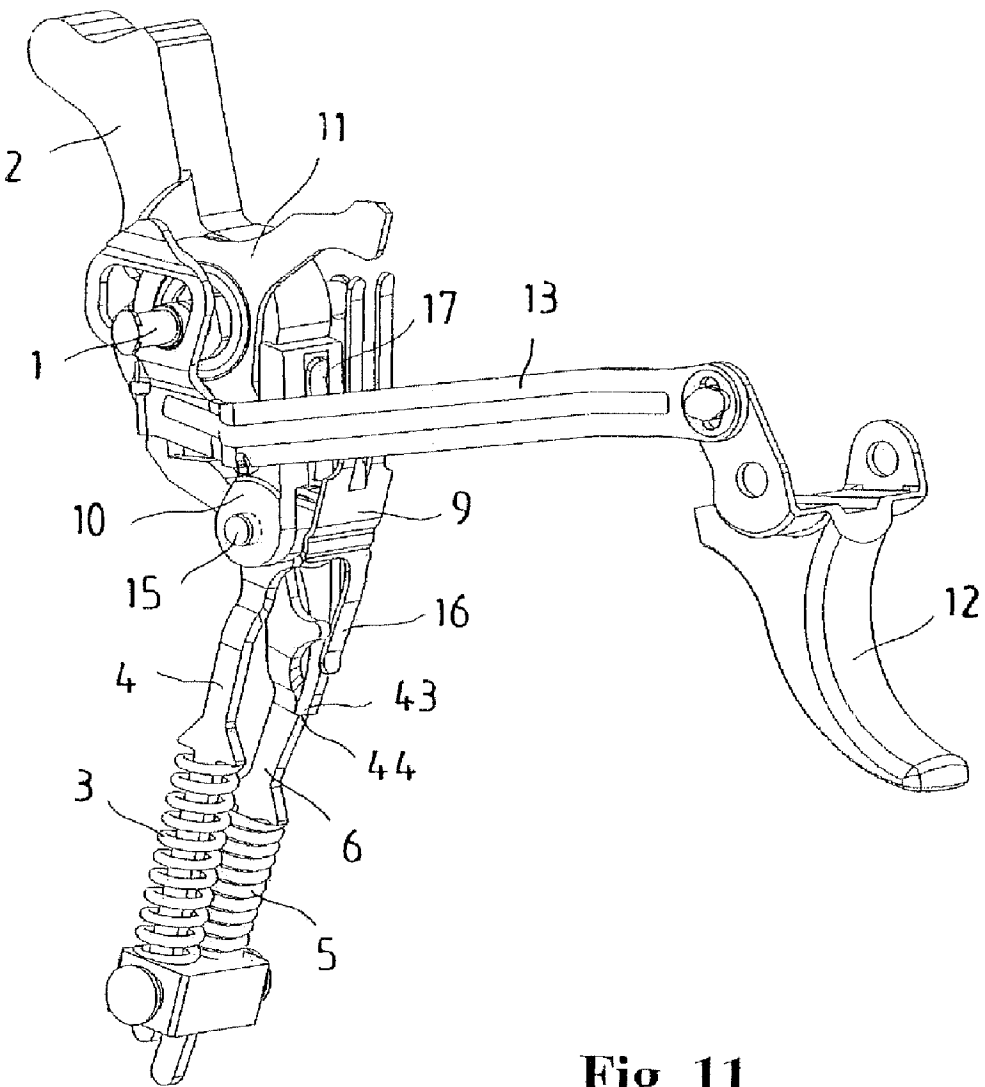
FIG. 11, a perspective representation of the trigger mechanism according to FIG. 1 in a partially pre-tensioned position.

If the striking lever 2 is pivoted rearward either manually or due to the repeating process of the not-shown breech lock or slide in the initial position shown in FIGS. 1, 2 and 10, the rearward movement of the striking lever 2 initially presses both striking spring rods 4 and 6 downward and forward against the force of the respective striking springs 3 and 5. During this process, the drive detent 43 and the striking spring rod detent 44 of the second striking spring rod 6 according to FIG. 11 are engaged such that the second striking spring 5 is held in a pre-tensioned position. The pre-tensioned state of the trigger mechanism shown in FIG. 11 can be realized by tensioning only the second striking spring 5. The first striking spring 3, in contrast, is relaxed once again when the striking lever 2 is pivoted forward until the safety detent 22 of the striking lever 2 engages with the catch detent 48 of the catch 10.

Figure 12:
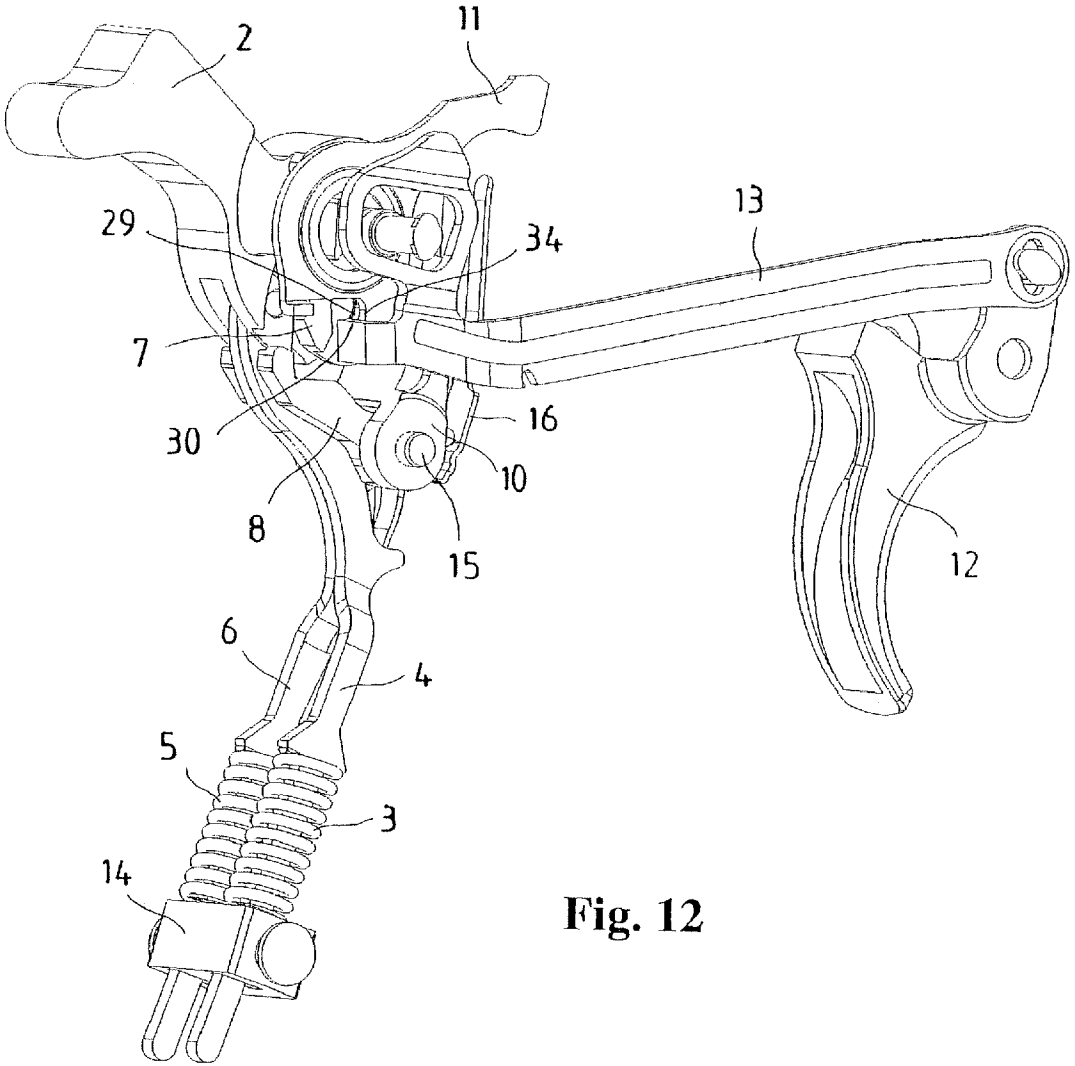
FIG. 12, a perspective representation of the trigger mechanism according to FIG. 1 during the actuation of the trigger.
Figure 13:
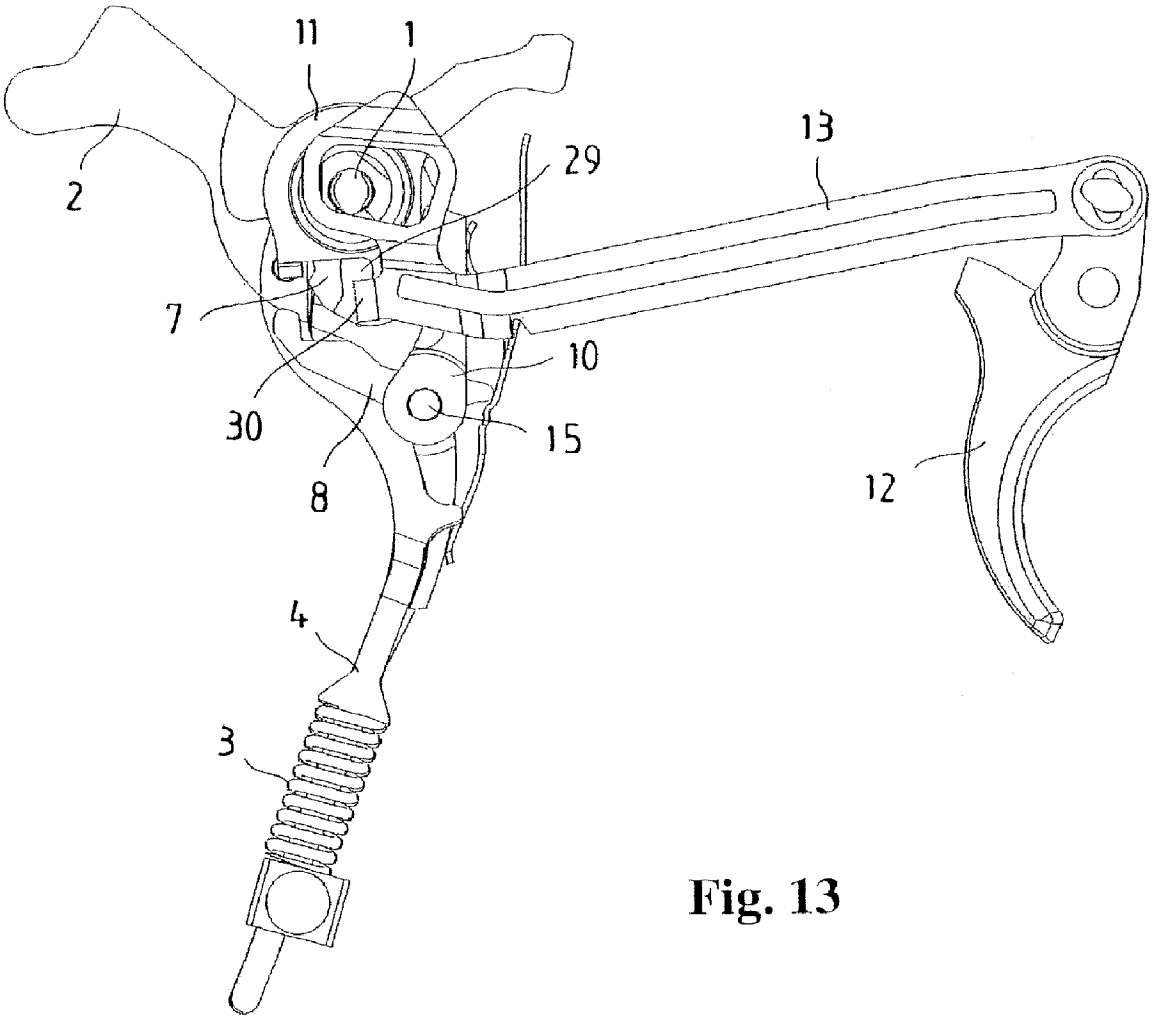
FIG. 13, a side view of the trigger mechanism according to FIG. 1 in the position shown in FIG. 12.

The trigger rod 13 is moved forward (toward the right in FIGS. 12 and 13) if the trigger 12 is actuated in the pre-tensioned position shown in FIG. 11, wherein the striking lever 2 is pivoted rearwards as shown in FIGS. 12 and 13 by the control element 7 and the trigger rod 13, the trigger rod detent 30 of which is engaged with the control element detent 29, such that the first striking spring 3 is also tensioned by means of the first striking spring rod 4.

Figure 14:
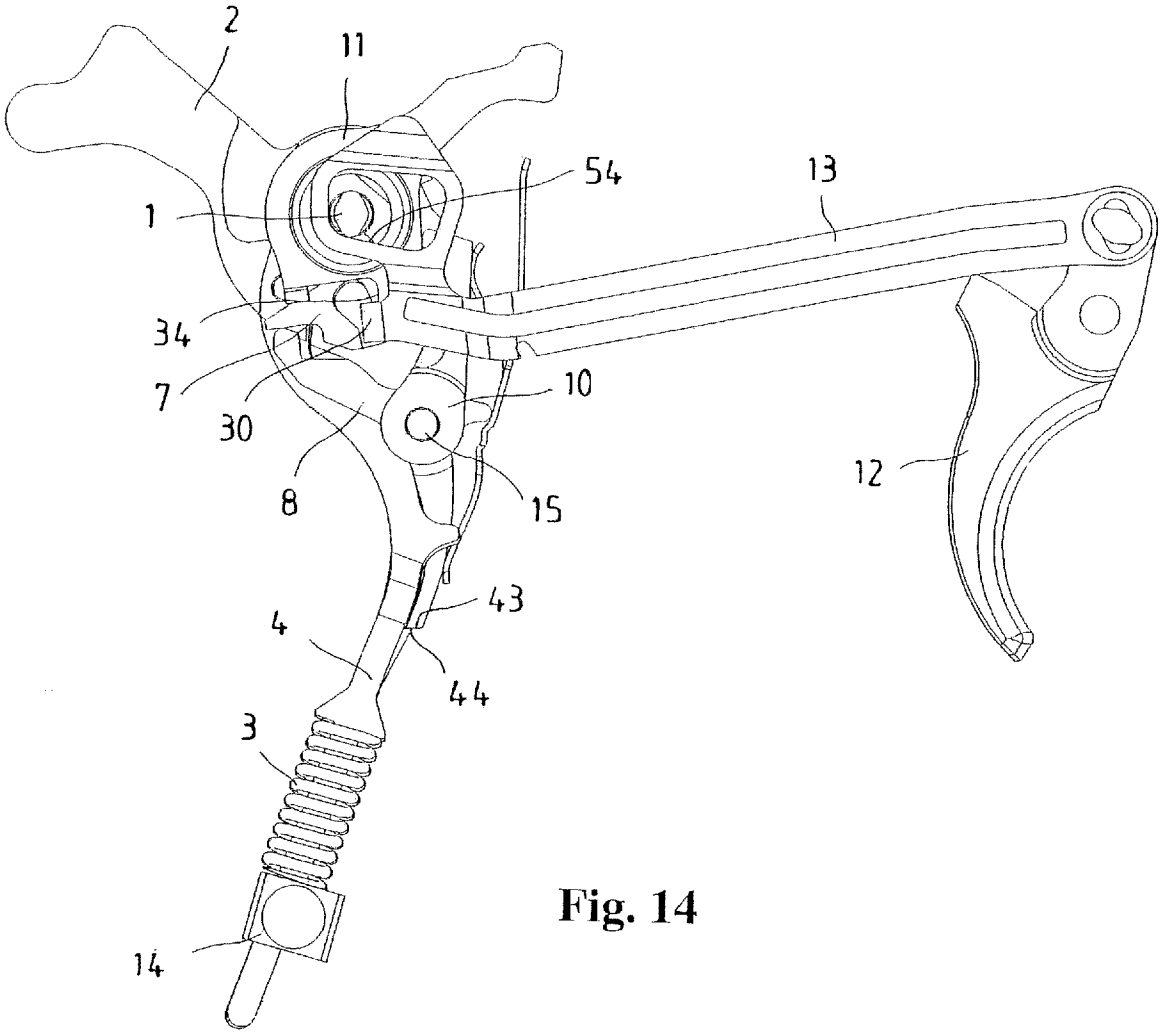
FIG. 14, a side view of the trigger mechanism according to FIG. 1 shortly before the release of the striking lever.

If the trigger 12 is also actuated, the safety lever detent 34 of the safety lever 11 according to FIG. 14 is engaged with the trigger rod detent 30 such that the safety lever 11 is turned in the counterclockwise direction by the trigger rod 13. During this process, the font safety lever cam 35 of the safety lever 11 shown in FIG. 5 comes in contact with the catch surface 56 of the catch 10 shown in FIG. 7 such that the safety lever 11 presses the catch 10 into a position in which the catch detent 48 can no longer engage with the firing detent 21 of the striking lever 2. The trigger rod 13 is moved downwards by the control bevel 54 of the trigger rod 13 that is in contact with the striking lever axis 1, i.e., into a position in which the trigger rod detent 30 is disengaged from the control element detent 29 of the control element 7 and thus releases the striking lever 2 from the tensioned position shown in FIG. 14 in order to fire a shot.

Figure 15:
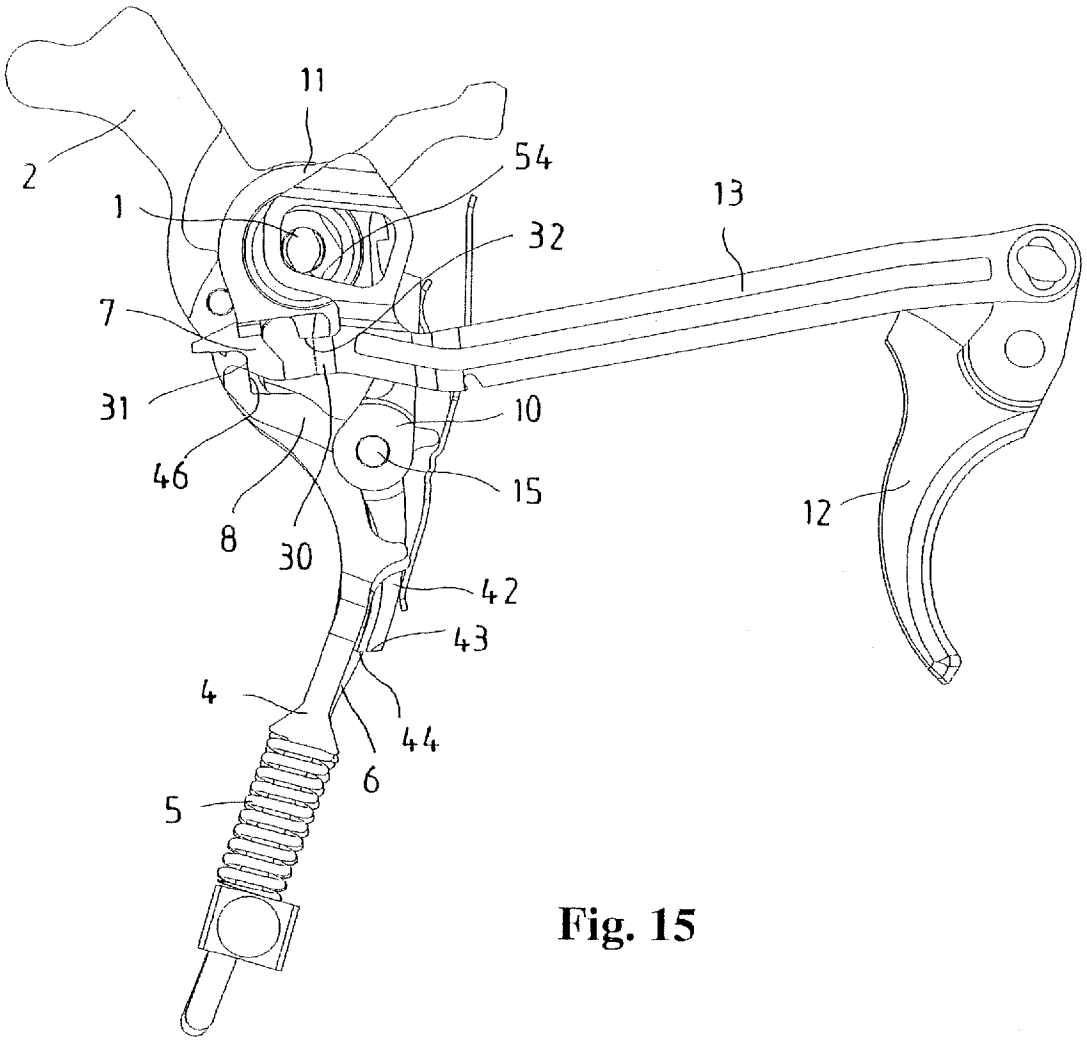
FIG. 15, a side view of the trigger mechanism according to FIG. 1 curing the striking movement of the striking lever, and FIG. 16, a side view of the trigger mechanism according to FIG. 1 when a shot is fired.

During the firing caused by the first striking spring 3, the control element 7 is also displaced during the forward movement of the striking lever 2. This causes the front control surface 32 of the control element 7 to engage with the trigger rod detent 30. The control element 7 is turned in the counterclockwise direction relative to the striking lever 2 due to a rolling motion between the control surface 32 and the trigger rod detent 30 such that the rear control surface 31 of the control element 7 is pivoted downward and engages with the contact surface 46 of the drive element 8 during the additional forward movement of the striking lever 2, as shown in FIG. 15. During this process, the drive element 8 is turned in the counterclockwise direction such that the lower leg 42 moves forward and the drive detent 43 is disengaged from the striking spring rod detent 44. The second striking spring rod 6 is therefore released and the second striking spring 5 becomes effective from its pre-tensioned position.

Figure 16:
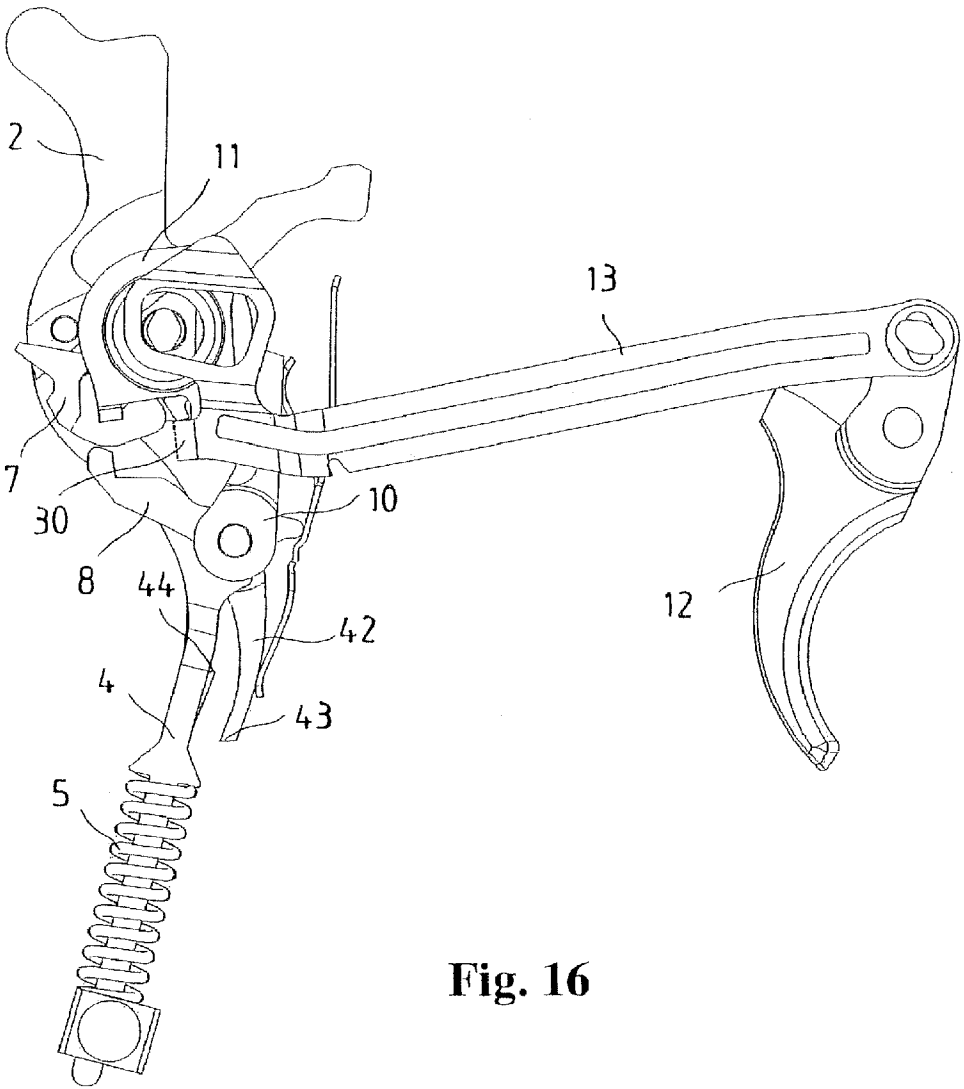

The striking lever 2 is then moved forward into the position shown in FIG. 16 by the two striking springs 3 and 5 that now act in parallel and the corresponding striking spring rods 4 and 6, respectively, wherein the striking lever is then able to actuate a not-shown striking pin in order to fire a shot.

The operation of the above-described trigger mechanism essentially corresponds to that of a pre-tensioned single-action/double-action trigger mechanism with the option of varying the function and the characteristic of the trigger mechanism by exchanging or adapting the control element.

The invention claimed is:

1. A trigger mechanism for handguns with a striking lever (2), a first striking spring (3) that is assigned to the striking lever (2) and serves for acting upon the striking lever (2) in the firing direction, a second striking spring (5) that is arranged parallel to the first striking spring and acts upon the striking lever (2) in the firing direction, a trigger (12), a trigger rod (13) connected to the trigger (12) that releases the striking lever (2) in a tensioned position in order to fire a shot, and a control element (7) rotatably arranged in the striking lever (2) that features a control element detent (29) for engaging with a trigger rod detent (30) of the trigger rod (13), characterized by the fact that the control element (7) cooperates with a drive element (8) in order to pre-tension or release the second striking spring (5).

2. The trigger mechanism according to claim 1, characterized by the fact that the control element (7) features a first control surface (31) that cooperates with the trigger rod detent (30) and a second control surface (33) that serves for engaging with a contact surface (46) of the drive element (8).

3. The trigger mechanism according to claim 2, characterized by the fact that the contact surface (46) is arranged on a control cam (45) on a rearward extension (40) of the drive element (8).

4. The trigger mechanism according to claim 1, characterized by the fact that the control element (7) is inserted into a bore (24) for supporting the striking lever (2) that is laterally offset relative to a through-hole (25) for a striking lever axis (1) by means of a laterally protruding pin (28).

5. The trigger mechanism according to claim 2, characterized by the fact that the drive element (8) features a drive detent (43) for engaging with a striking spring rod detent (44) on a striking spring rod (6) assigned to the second striking spring (5).

6. The trigger mechanism according to claim 5, characterized by the fact that the drive detent (44) is arranged on a downward projection (42) of the drive element (8).

7. The trigger mechanism according to claim 6, characterized by the fact that the downward projection of the drive element (8) is pressed in the direction of the striking spring rod (6) by a lower leg (16) of a spring (9).

8. The trigger mechanism according to claim 2, characterized by the fact that the drive element (8) is rotatably arranged on a transverse shaft (15) by means of a bore (38).

9. The trigger mechanism according to claim 1, characterized by the fact that the striking lever (2) features a firing detent (21) and a safety detent (22) arranged above the firing detent that serves for engaging with a catch (10).

10. The trigger mechanism according to claim 1, characterized by the fact that the catch (10) features a catch surface (56) for contacting a safety lever (11).

11. The trigger mechanism according to claim 10, characterized by the fact that the safety lever (11) is rotatably supported on a bearing stud (27) of the striking lever (2) by means of a bore (33).

12. The trigger mechanism according to claim 10, characterized by the fact that the safety lever (11) features a safety lever detent (34) and a safety lever cam (35) that cooperates with the catch (10).

13. The trigger mechanism according to claim 1, characterized by the act that the two striking springs (3, 5) are arranged on two adjacent and parallel striking spring rods (4, 6).

14. A trigger mechanism for handguns, comprising:

a striking lever being movable in a firing direction from a tensioned position in order to fire a shot;

a first striking spring being configured to move said striking lever in the firing direction;

a second striking spring being aligned parallel to said first striking spring and being configured to move said striking lever in the firing direction;

a trigger for releasing said striking lever when pulled;

a trigger rod connected to said trigger and having a trigger rod detent;

a control element rotating on said striking lever and having a control element detent engaging said trigger rod detent when said trigger is being pulled;

a drive element interconnecting said control element and second striking spring when said trigger is being pulled, pre-tensioning said second striking spring when said trigger is being pulled, and releasing said second striking spring to move said striking lever in the firing direction under a force of said first striking spring and said second striking spring when said trigger is being pulled.

15. The trigger mechanism according to claim 14, wherein said first striking lever is pre-tensioned by a means for pre-tensioning said first striking spring other than said trigger.

16. The trigger mechanism according to claim 14, wherein said trigger only pre-tensions said second striking spring.

17. The trigger mechanism according to claim 14, wherein said trigger does not pre-tension said first striking spring.

18. The trigger mechanism according to claim 15, wherein said means for pre-tensioning said first striking spring does not pre-tension said second striking spring.

* * * * *